US009268258B2

(12) United States Patent
Funada

(10) Patent No.: US 9,268,258 B2
(45) Date of Patent: Feb. 23, 2016

(54) IMAGE FORMING APPARATUS

(71) Applicant: FUJI XEROX CO., LTD., Minato-ku, Tokyo (JP)

(72) Inventor: Atsushi Funada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/485,963

(22) Filed: Sep. 15, 2014

(65) Prior Publication Data

US 2015/0268582 A1 Sep. 24, 2015

(30) Foreign Application Priority Data

Mar. 18, 2014 (JP) ..... 2014-054309

(51) Int. Cl.
*G03G 15/08* (2006.01)

(52) U.S. Cl.
CPC ..... *G03G 15/0881* (2013.01); *G03G 15/0865* (2013.01)

(58) Field of Classification Search
CPC ..... G03G 15/0865; G03G 15/0877; G03G 15/0886; G03G 15/0879
USPC ..... 399/258
See application file for complete search history.

(56) References Cited

U.S. PATENT DOCUMENTS

| | | | | |
|---|---|---|---|---|
| 2007/0223947 | A1* | 9/2007 | Ohkawa et al. | 399/27 |
| 2007/0274737 | A1* | 11/2007 | Serizawa et al. | 399/106 |
| 2012/0230736 | A1* | 9/2012 | Hosokawa | G03G 15/0886 399/262 |
| 2013/0183064 | A1* | 7/2013 | Sato | 399/258 |

FOREIGN PATENT DOCUMENTS

| | | | |
|---|---|---|---|
| JP | 11-223990 | A | 8/1999 |
| JP | 2001-005286 | A | 1/2001 |
| JP | 2001-125359 | A | 5/2001 |

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

An image forming apparatus includes a developing device that has a supply port through which developer is supplied, the developing device developing an image with developer; a developer supply device to which the developing device is removably attached, the developer supply device having a discharge port to be connected to the supply port when the developing device is attached to the developer supply device, the developer supply device supplying the developer to the developing device through the discharge port; a seal member that seals between the supply port and the discharge port; and a guide portion that guides attachment of the developing device to the developer supply device or removal of the developing device from the developer supply device so as not to rub the seal member.

6 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2014-054309 filed Mar. 18, 2014.

BACKGROUND

Technical Field

The present invention relates to an image forming apparatus.

SUMMARY

According to an aspect of the invention, there is provided an image forming apparatus including a developing device that has a supply port through which developer is supplied, the developing device developing an image with developer; a developer supply device to which the developing device is removably attached, the developer supply device having a discharge port to be connected to the supply port when the developing device is attached to the developer supply device, the developer supply device supplying the developer to the developing device through the discharge port; a seal member that seals between the supply port and the discharge port; and a guide portion that guides attachment of the developing device to the developer supply device or removal of the developing device from the developer supply device so as not to rub the seal member.

BRIEF DESCRIPTION OF THE DRAWINGS

Exemplary embodiments of the present invention will be described in detail based on the following figures, wherein:

FIGS. 3A and 3B are diagrams for explaining the movement of a developing device constituting the image forming apparatus shown in FIG. 1, wherein FIG. 3A shows a state in which a developer carrier constituting the developing device is in contact with a latent image carrier and FIG. 3B shows a state in which the developer carrier constituting the developing device is away from the latent image carrier;

FIGS. 9A and 9B are diagrams for explaining the movement of the guide portion shown in FIG. 8, wherein FIG. 9A shows a state immediately before the supply port and a discharge port are connected to each other, and FIG. 9B shows a state in which the supply port and the discharge port are connected to each other; and FIGS. 10A and 10B show the configuration and movement of a guide portion of an image forming apparatus according to a second exemplary embodiment of the present invention, wherein FIG. 10A shows a state immediately before a supply port and a discharge port are connected to each other, and FIG. 10B shows a state in which the supply port and the discharge port are connected to each other.

DETAILED DESCRIPTION

Figure 1:
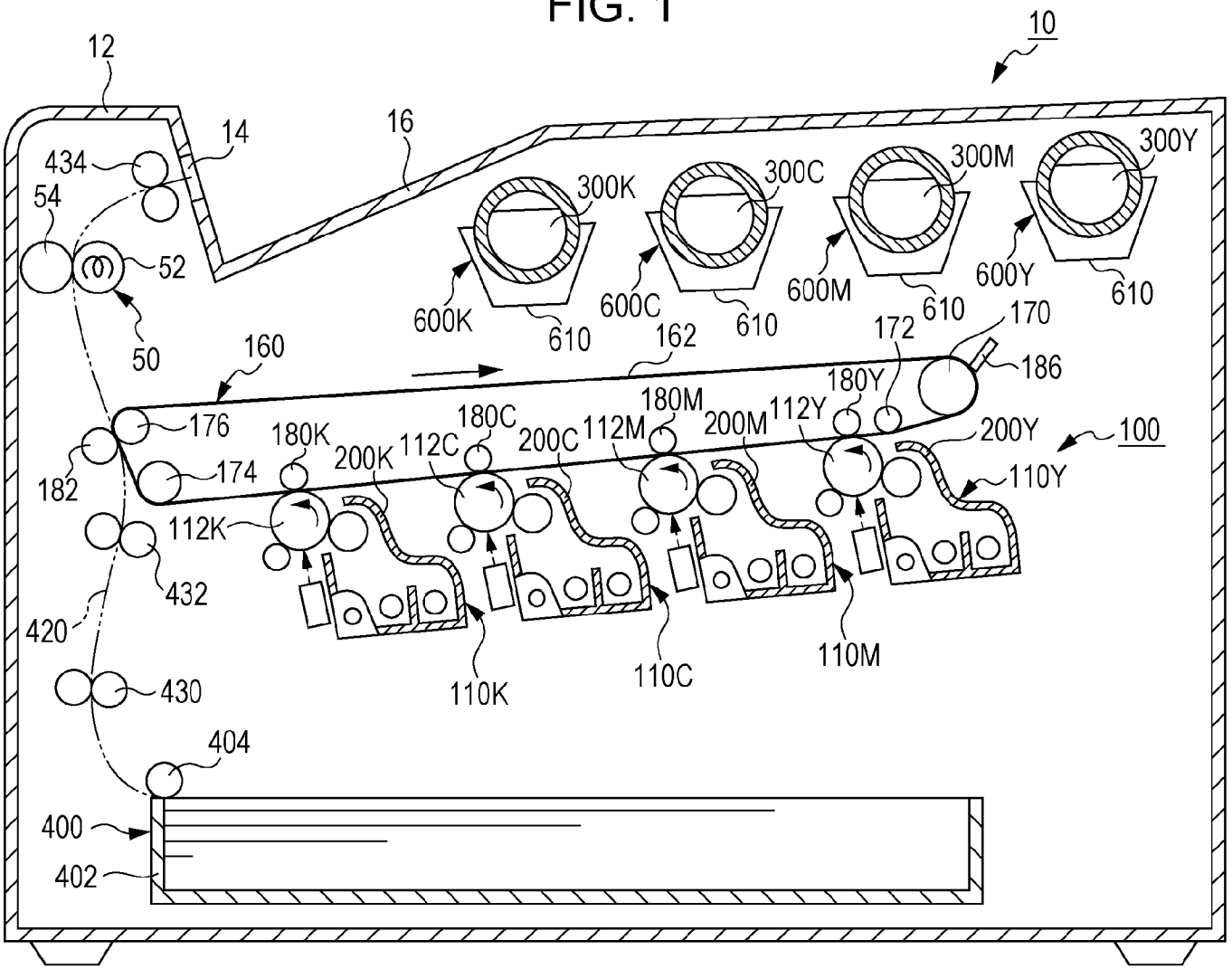
FIG. 1 schematically shows the configuration of an image forming apparatus according to a first exemplary embodiment of the present invention.

Next, exemplary embodiments of the present invention will be described with reference to the drawings. FIG. 1 shows an image forming apparatus 10 according to a first exemplary embodiment of the present invention. As shown in FIG. 1, the image forming apparatus 10 includes an image forming apparatus body 12. The image forming apparatus body 12 has a discharge port 14 from which a sheet, serving as a recording medium, is discharged. The upper surface of the image forming apparatus body 12 is used as a discharge portion 16 onto which a sheet having an image formed thereon is discharged.

The image forming apparatus body 12 accommodates an image forming section 100 that includes a developing device 200Y, a developing device 200M, a developing device 200C, and a developing device 200K and forms a developer image on a sheet; and a sheet feed device 400 that supplies a sheet to the image forming section 100. Furthermore, a yellow developer container 300Y, a magenta developer container 300M, a cyan developer container 300C, and a black developer container 300K are attached to the image forming apparatus body 12 in such a manner that they are independently removable.

The image forming apparatus body 12 also accommodates a developer supply device 600Y, a developer supply device 600M, a developer supply device 600C, and a developer supply device 600K that supply developer to the developing device 200Y, the developing device 200M, the developing device 200C, and the developing device 200K, respectively. Note that, in FIG. 1, for ease of illustration, the developer supply device 600Y, the developer supply device 600M, the developer supply device 600C, and the developer supply device 600K are illustrated in part.

The yellow developer container 300Y, the magenta developer container 300M, the cyan developer container 300C, and the black developer container 300K store yellow developer, magenta developer, cyan developer, and black developer, respectively. Furthermore, the yellow developer container 300Y, the magenta developer container 300M, the cyan developer container 300C, and the black developer container 300K are attached to the developer supply device 600Y, the developer supply device 600M, the developer supply device 600C, and the developer supply device 600K, respectively, in a removable manner.

The image forming section 100 includes a yellow image forming section 110Y, a magenta image forming section 110M, a cyan image forming section 110C, a black image forming section 110K, and a transfer device 160. The yellow image forming section 110Y, the magenta image forming section 110M, the cyan image forming section 110C, and the black image forming section 110K include a photoconductor drum 112Y, a photoconductor drum 112M, a photoconductor drum 112C, and a photoconductor drum 112K, respectively.

The photoconductor drum 112Y, the photoconductor drum 112M, the photoconductor drum 112C, and the photoconductor drum 112K are used as latent image carriers that carry latent images to be developed by the developing device 200Y, the developing device 200M, the developing device 200C, and the developing device 200K, respectively.

The yellow image forming section 110Y, the magenta image forming section 110M, the cyan image forming section 110C, and the black image forming section 110K form a yellow developer image with yellow developer, a magenta developer image with magenta developer, a cyan developer image with cyan developer image, and a black developer image with black developer, respectively. The yellow image forming section 110Y, the magenta image forming section 110M, the cyan image forming section 110C, and the black image forming section 110K will be described in detail below.

The transfer device 160 includes a transfer member 162 to which developer images are transferred from the photoconductor drum 112Y, the photoconductor drum 112M, the photoconductor drum 112C, and the photoconductor drum 112K. The transfer member 162 has an endless belt structure and is wound around a support roller 170, a support roller 172, a support roller 174, and a support roller 176 in such a manner that it is rotated in a direction indicated by an arrow in FIG. 1. At least one of the support roller 170, the support roller 172, the support roller 174, and the support roller 176 serves as a driving roller that transmits driving force to the transfer member 162.

The transfer device 160 includes a first transfer device 180Y, a first transfer device 180M, a first transfer device 180C, and a first transfer device 180K that transfer the developer images formed on the photoconductor drum 112Y, the photoconductor drum 112M, the photoconductor drum 112C, and the photoconductor drum 112K to the transfer member 162. The transfer device 160 includes a second transfer device 182 that transfers the developer image transferred to the transfer member 162 to a sheet.

The transfer device 160 also includes a cleaning device 186 that cleans the transfer member 162. The cleaning device 186 cleans the surface of the transfer member 162 by, for example, scraping off the developer etc. remaining thereon.

The image forming apparatus body 12 also accommodates a fixing device 50 that fixes the developer image, transferred to the sheet by the second transfer device 182, to the sheet. The fixing device 50 includes a heating roller 52 having a heat source, and a pressure roller 54 that applies pressure to the sheet by pressing the sheet against the heating roller 52. The fixing device 50 fixes the developer image to the sheet using the heat and pressure.

The sheet feed device 400 includes a container 402 that stores a stack of sheets. The sheet feed device 400 also includes a transport roller 404 that picks up a sheet on top of the stack stored in the container 402 and feeds the sheet to the image forming section 100.

Furthermore, a sheet transport path 420 used to transport the sheet is formed in the image forming apparatus body 12. The sheet transport path 420 is used to transport a sheet supplied from the sheet feed device 400 to the image forming section 100 and to discharge the sheet outside the image forming apparatus body 12 after an image is formed thereon. Furthermore, in the image forming apparatus body 12, the transport roller 404, transport rollers 430, register rollers 432, the support roller 176, the second transfer device 182, the fixing device 50, and discharge rollers 434 are arranged in sequence from the upstream side in a sheet-transport direction, along the sheet transport path 420.

The transport rollers 430 transport the sheet to the register rollers 432. The register rollers 432 temporarily stop the leading end of the sheet transported from the sheet feed device 400 and then feed the sheet to a position between the second transfer device 182 and the transfer member 162, in accordance with the timing of transfer of a developer image to the transfer member 162. The discharge rollers 434 discharge the sheet, onto which the developer image is fixed by the fixing device 50, to the discharge portion 16.

Figure 2:
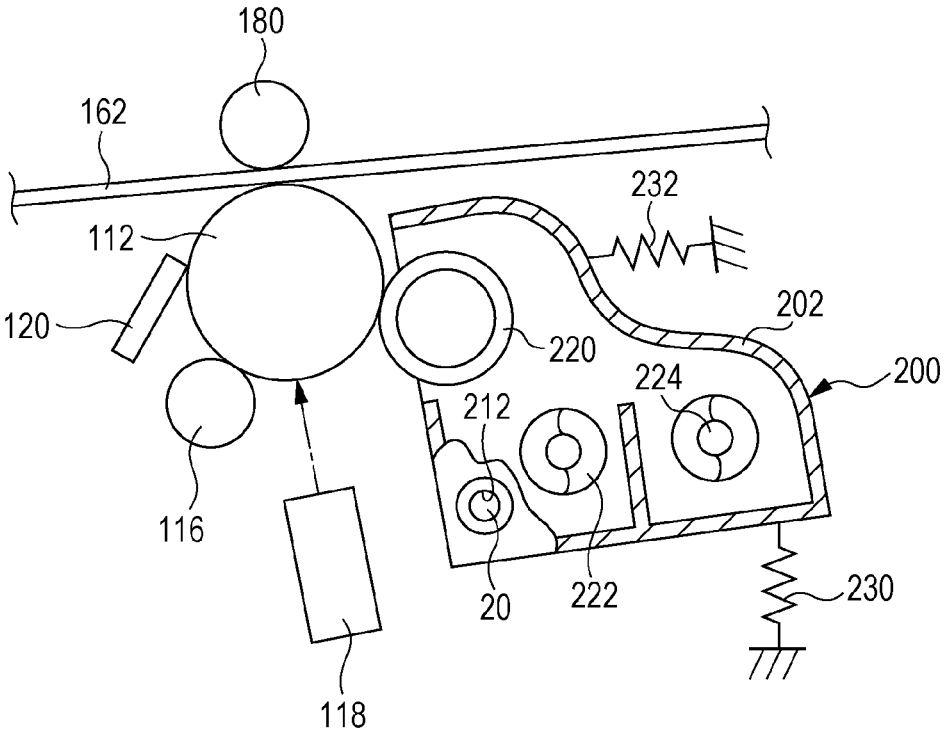
FIG. 2 shows an image forming section constituting the image forming apparatus shown in FIG. 1.

FIG. 2 shows one of the yellow image forming section 110Y, the magenta image forming section 110M, the cyan image forming section 110C, and the black image forming section 110K. Because the yellow image forming section 110Y, the magenta image forming section 110M, the cyan image forming section 110C, and the black image forming section 110K have the same configuration except for the color of the developer they use and the color of the developer images they form, they will be collectively called, an "image forming section 110".

As shown in FIG. 2, the image forming section 110 includes the photoconductor drum 112, a charger 116, a latent image forming device 118, the developing device 200, and a cleaning device 120. The charger 116 serves as a charging portion that charges the photoconductor drum 112, and uniformly charges the surface of the photoconductor drum 112. The latent image forming device 118 is, for example, a light-emitting diode (LED) array. The latent image forming device 118 forms a latent image on the surface of the photoconductor drum 112 by radiating light to the surface of the photoconductor drum 112 that has been uniformly charged by the charger 116. The cleaning device 120 cleans the photoconductor drum 112 by, for example, scraping off the developer image etc. remaining on the surface of the photoconductor drum 112.

The developing device 200 includes a developing device body 202. The developing device body 202 has a through-hole 212 extending in the longitudinal direction of the developing device body 202. The developing device 200 may be attached to or removed from the image forming apparatus body 12 by moving it in the front-rear direction (i.e., near-far direction in FIG. 2). More specifically, when the developing device 200 is attached to the image forming apparatus body 12, a support shaft 20 provided on the image forming apparatus body 12 is inserted into the through-hole 212, and when the developing device 200 is removed from the image forming apparatus body 12, the support shaft 20 is removed from the through-hole 212.

A first urging member 230 and a second urging member 232 that urge the developing device body 202 in the counter-clockwise direction about the support shaft 20 are attached to the developing device body 202. The first urging member 230 and the second urging member 232 are elastic members, such as coil springs. The first urging member 230 is fitted to a wall below the developing device body 202 at an end and pushes the lower surface of the developing device body 202 upward. The second urging member 232 is fitted to a wall to the right of the developing device body 202 at an end and pushes the developing device body 202 to the left.

The developing device body 202 accommodates a developing roller 220, a transport member 222, and a transport member 224. The developing roller 220 serves as a developer carrier that carries the developer and supplies the developer carrying on the surface thereof to the photoconductor drum 112. The transport members 222 and 224 are rotated to stir and transport the developer inside the developing device body 202.

Figure 3A:
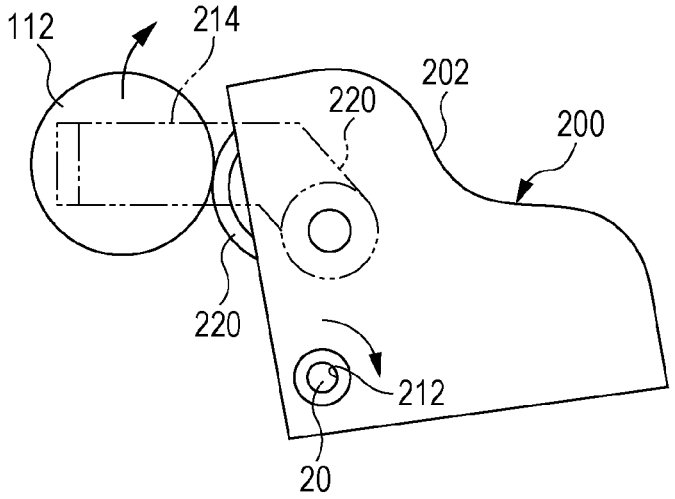
Figure 3B:
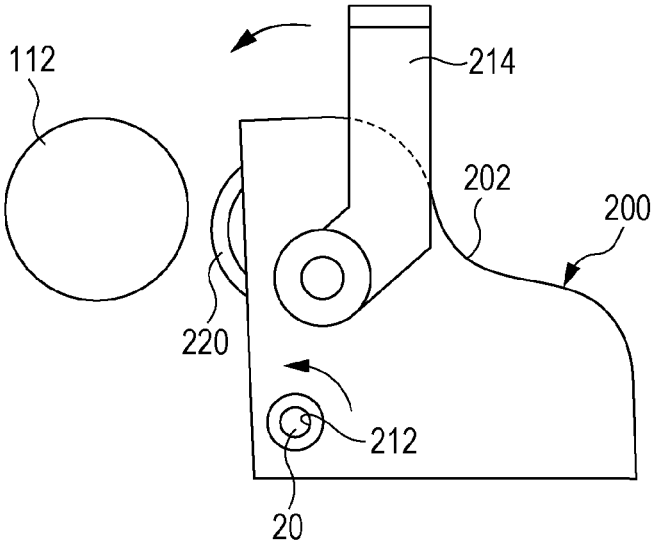

FIGS. 3A and 3B are diagrams for explaining the movement of the developing device 200. FIG. 3A shows a state in which the developing roller 220 is in contact with the photoconductor drum 112 with a spacer (not shown) therebetween, and FIG. 3B shows a state in which the developing roller 220 is away from the photoconductor drum 112. As shown in FIGS. 3A and 3B, a manipulation member 214 is attached to, for example, a front wall of the developing device body 202 so as to be able to rotate relative to the developing device body 202. By an operator rotating the manipulation member 214 in directions indicated by arrows in FIGS. 3A and 3B, the developing device 200 moves between a position shown in FIG. 3A and a position shown in FIG. 3B.

When a latent image formed on the photoconductor drum 112 is to be developed, the developing roller 220 of the developing device 200 is brought into contact with the photoconductor drum 112 with the spacer therebetween, as shown in FIG. 3A. When the developing device 200 is attached to or removed from the image forming apparatus body 12, the photoconductor drum 112 and the developing roller 220 are separated, as shown in FIG. 3B. Because the developing device 200 is attached to or removed from the image forming apparatus body 12 while the photoconductor drum 112 is away from the developing roller 220, friction between the photoconductor drum 112 and the developing roller 220 is less likely to occur, and hence, deterioration of the photoconductor drum 112 and the developing roller 220 is less likely to occur. Note that, for ease of illustration, the manipulation member 214 in FIG. 3A is illustrated by an imaginary line.

Figure 4:
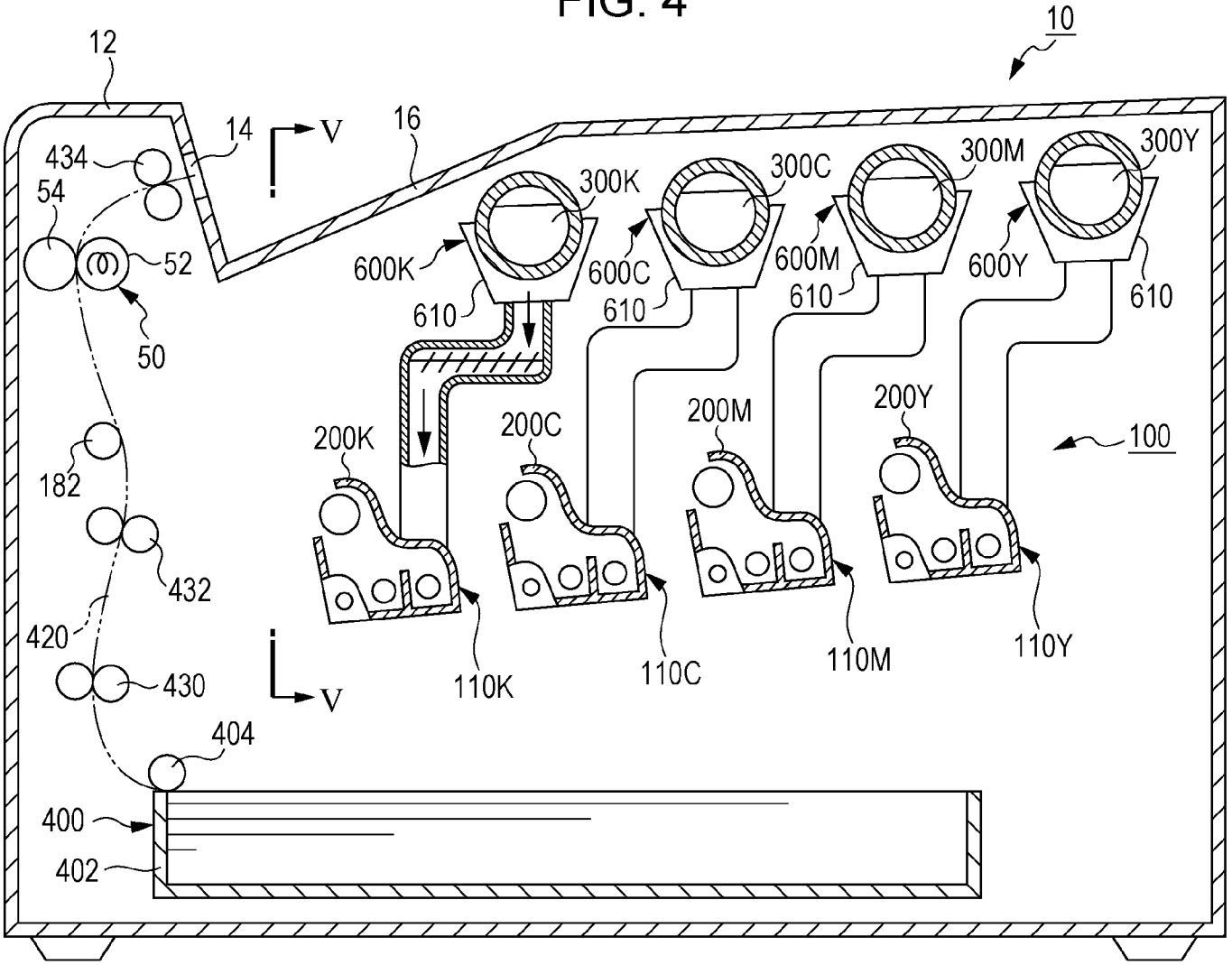
FIG. 4 shows a developer supply device constituting the image forming apparatus shown in FIG. 1.

FIG. 4 shows the developer supply device 600Y, the developer supply device 600M, the developer supply device 600C, and the developer supply device 600K. Because the developer supply device 600Y, the developer supply device 600M, the developer supply device 600C, and the developer supply device 600K have the same configuration except for the color of the developer they supply, they will be collectively called, a "developer supply device 600". In addition, because the developer container 300Y, the developer container 300M, the developer container 300C, and the developer container 300K have the same configuration except for the color of the developer they store, they will be collectively called, a "developer container 300".

Whereas the developing device 200, described above, is capable of being attached to or removed from the image forming apparatus body 12, the developer supply device 600 is fixed to the image forming apparatus body 12. Furthermore, the developer supply device 600 includes a guide member 610. The guide member 610 guides attachment/removal of the developer container 300 to/from the developer supply device 600. By pulling the developer container 300 to the front side using the guide member 610 as a guide, the developer container 300 is removed from the developer supply device 600. Furthermore, by pushing the developer container 300 to the rear side using the guide member 610 as a guide, the developer container 300 is attached to the developer supply device 600.

The developer supply device 600 includes a transport-path forming member 622 that constitutes a developer transport path 620 for transporting the developer discharged from the developer container 300 to the developing device 200. A detailed description of the developer supply device 600 will be given below.

Figure 5:
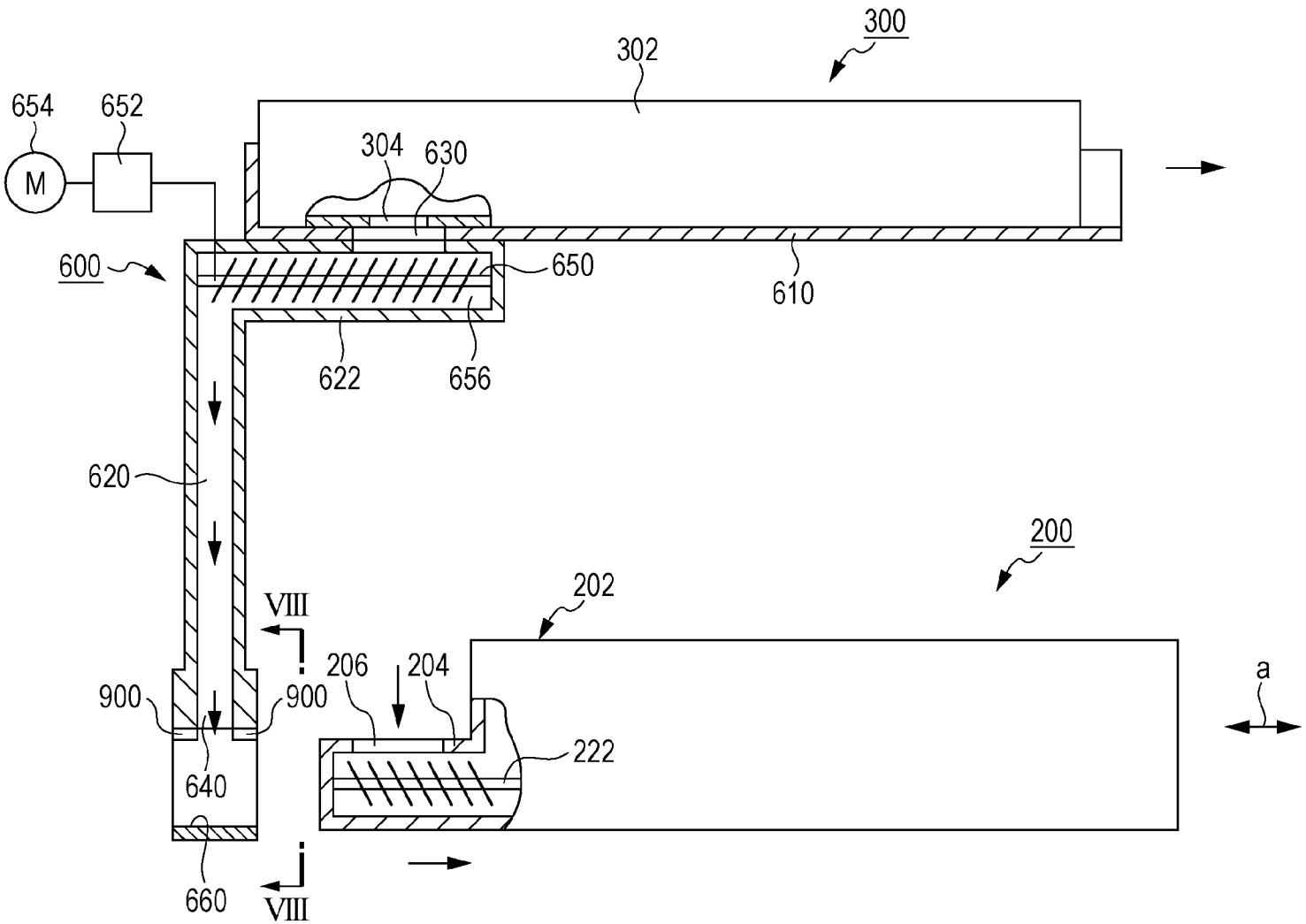
FIG. 5 shows the developer container, developing device, and developer supply device constituting the image forming apparatus shown in FIG. 1, and it also schematically shows the configuration of the image forming apparatus, as viewed from the direction indicated by arrows V-V in FIG. 4.

FIG. 5 shows the developer container 300, the developing device 200, and the developer supply device 600. As shown in FIG. 5, the developer container 300 includes a container body 302. The container body 302 is provided with a discharge port 304 in the lower wall thereof, through which the developer is discharged from the inside of the outside of the developer container 300 to the outside of the developer container 300. The developer container 300 is provided with an opening/closing mechanism (not shown) that opens the discharge port 304 when the developer container 300 is attached to the developer supply device 600 and closes the discharge port 304 when the developer container 300 is removed from the developer supply device 600.

The discharge port 304 is formed in the container body 302 such that the discharge port 304 is located above a supply port 630 (described below) in the gravity direction when the developer container 300 is fitted to the developer supply device 600.

The developing device 200 is moved in directions indicated by an arrow a in FIG. 5 when attached to or removed from the image forming apparatus body 12 (see FIG. 1). When the developing device 200 is attached to the image forming apparatus body 12, the developing device 200 attached to the developer supply device 600, and the developing device 200 is removed from the image forming apparatus body 12, the developing device 200 is removed from the developer supply device 600. FIG. 5 shows a state immediately before attachment of the developing device 200 to the image forming apparatus body 12 and the developer supply device 600 is completed. Attachment/removal of the developing device 200 to/from the developer supply device 600 is guided by a guide mechanism 800 (described below, and see FIGS. 8 and 9).

The developing device body 202 of the developing device 200 has a projecting portion 204 projecting to the rear side (left in FIG. 5). The projecting portion 204 has a supply port 206 in the upper surface in the gravity direction, through which the developer is supplied to the developing device 200. When the developing device 200 is attached to the developer supply device 600, the supply port 206 is connected to a discharge port 640 (described below) of the developer supply device 600. The supply port 206 is formed above the transport member 222 in the gravity direction. Hence, the developer supplied to the developing device 200 through the supply port 206 falls onto the transport member 222 and is stirred and transported by the transport member 222.

As has been described above, the developer supply device 600 includes the guide member 610 and the transport-path forming member 622 that constitutes the developer transport path 620. The developer supply device 600 has the supply port 630 extending through the guide member 610 and the transport-path forming member 622. The supply port 630 is provided in the upper wall of the developer supply device 600 in the gravity direction, and the developer moves from the developer container 300 to the developer supply device 600 through the supply port 630 and the discharge port 304 provided in the developer container 300.

The developer transport path 620 includes a portion that transports the developer substantially horizontally and a portion that transports the developer substantially vertically so as to allow the developer to fall inside the developing device. A transport member 650 for transporting the developer is disposed in the portion of the developer transport path 620 that transports the developer substantially horizontally. The transport member 650 is connected to a motor 654, serving as a driving source, via a driving force transmission mechanism 652 formed of, for example, a gear train. The transport member 650 is rotated by the driving force transmitted from the motor 654, thereby transporting the developer in the developer transport path 620 so as to push out the developer with a blade portion 656.

The developer supply device 600 has the discharge port 640. The discharge port 640 is an opening through which the developer is discharged to the outside of the developer supply device 600. When the developing device 200 is attached to the developer supply device 600, the discharge port 640 is connected to the supply port 206 in the developing device 200. The discharge port 640 is provided at the lower end in the gravity direction.

The developer supply device 600 also has an attaching portion 660 into which the projecting portion 204 of the developing device body 202 is inserted, allowing the developing device 200 to be attached to the developer supply device 600. Furthermore, a seal member 900 that seals between the discharge port 640 and the supply port 206 in the developing device 200 is provided near the discharge port 640.

Figure 6:
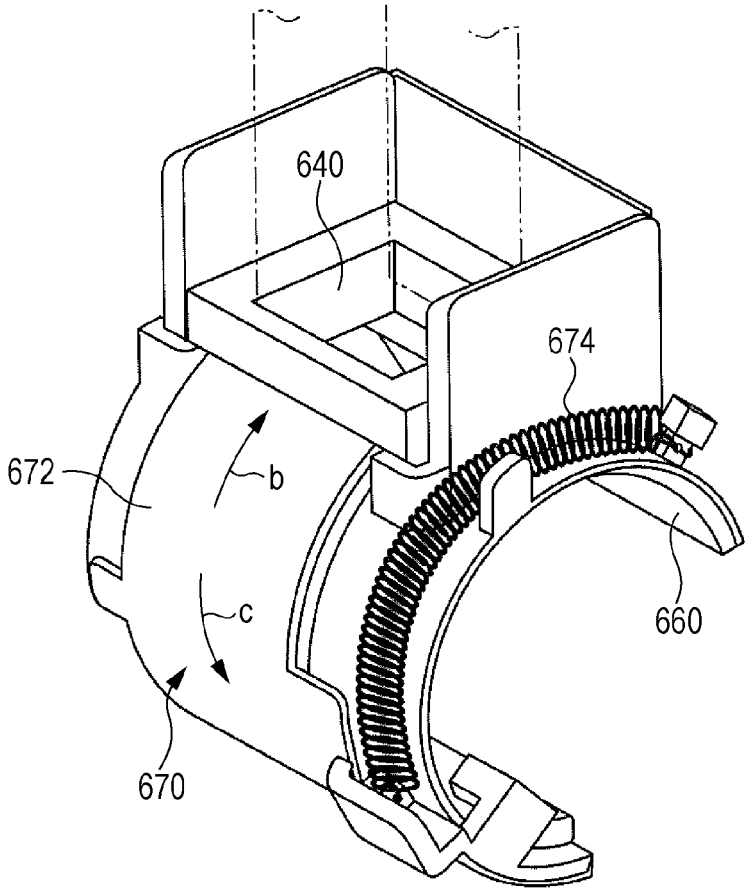
FIG. 6 shows a closing mechanism for closing a supply port provided in the developer supply device of the image forming apparatus shown in FIG. 1.

FIG. 6 shows a closing mechanism 670 constituting the developer supply device 600. The closing mechanism 670 serves as a closing member that closes the discharge port 640 when the developing device 200 is removed from the developer supply device 600. The closing mechanism 670 includes a closing member 672. The closing member 672 is movable between a position where the discharge port 640 is open and a position where the discharge port 640 is closed. The closing member 672 is attached to the attaching portion 660 so as to partially cover an outer surface of the substantially cylindrical attaching portion 660 and is movable in directions indicated by arrows b and c in FIG. 6 relative to the outer surface of the attaching portion 660. FIG. 6 shows the closing member 672 at a position where the discharge port 640 is open.

Furthermore, the closing mechanism 670 has an urging member 674. The urging member 674 is formed of an elastic member, such as a coil spring. One end of the urging member 674 is attached to the attaching portion 660, and the other end of the urging member 674 is attached to the closing member 672. The urging member 674 urges the closing member 672 in the arrow b direction shown in FIG. 6, which is the direction in which the closing member 672 is moved when the discharge port 640 is to be closed.

Figure 7:
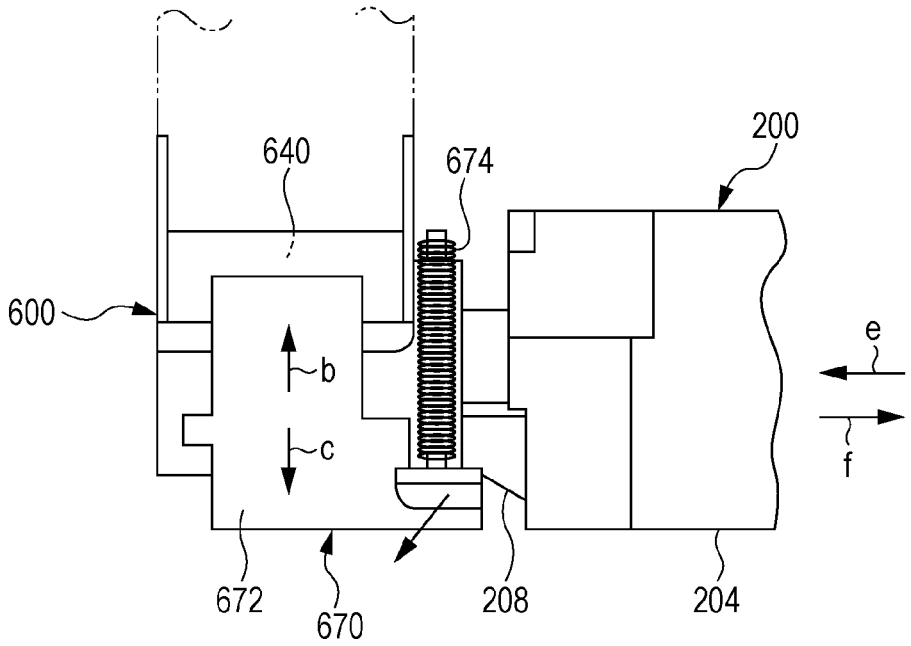
FIG. 7 is a diagram for explaining the movement of the closing mechanism shown in FIG. 6.

FIG. 7 shows the movement of the closing mechanism 670. As shown in FIG. 7, a pushing portion 208 is formed on the projecting portion 204 of the developing device body 202. The pushing portion 208 is brought into contact with the closing member 672 and moves the closing member 672 by resisting the urging force exerted by the urging member 674. The pushing portion 208 is an inclined surface that is inclined with respect to the direction in which the developing device 200 is attached to or removed from the developer supply device 600.

When the developing device 200 located at the position shown in FIG. 7 is pushed in an arrow e direction shown in FIG. 7 to attach the developing device 200 to the developer supply device 600, the pushing portion 208 pushes the closing member 672, moving the closing member 672 in the arrow c direction shown in FIGS. 7 and 6 by resisting the urging force exerted by the urging member 674 and opening the discharge port 640. On the other hand, when the developing device 200 at the position shown in FIG. 7 is moved in an arrow f direction shown in FIG. 7 to remove the developing device 200 from the developer supply device 600, the pushing portion 208 is separated from the closing member 672, allowing the urging member 674 to urge the closing member 672 to a position where the discharge port 640 is closed.

Figure 8:
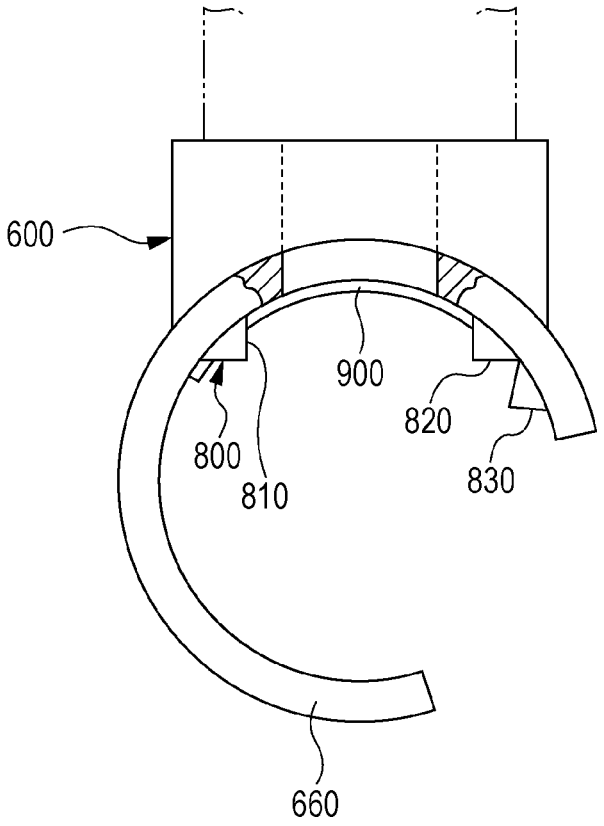
FIG. 8 shows a guide portion of the image forming apparatus shown in FIG. 1, and it also shows part of the developer supply device, as viewed from the direction indicated by arrows VIII-VIII in FIG. 5.

FIG. 8 shows the vicinity of the attaching portion 660 of the developer supply device 600, as viewed from the direction indicated by arrows VIII-VIII in FIG. 5, and it also shows the guide mechanism 800. The depth direction in FIG. 8 corresponds to an attachment/removal direction of the developing device 200 to/from the developer supply device 600 (see the arrow a in FIG. 5). The guide mechanism 800 serves as a guide portion that guides attachment/removal of the developing device 200 to/from the developer supply device 600 so as not to rub the seal member 900 when the developing device 200 is attached to or removed from the developer supply device 600.

The guide mechanism 800 includes multiple projecting portions, namely, a first projecting portion 810, a second projecting portion 820, and a third projecting portion 830 that are provided on the inner surface of the attaching portion 660 so as to face the inner side thereof and are provided side-by-side in a direction in which the discharge port 640 expands as the closing member 672 is moved. In FIG. 8, the first projecting portion 810 is provided to the left of the discharge port 640, that is, the first projecting portion 810 is provided at a side close to the photoconductor drum 112 (for example, see FIG. 3) with respect to the discharge port 640. The second projecting portion 820 and the third projecting portion 830 are provided at a side farther from the photoconductor drum 112 with respect to the discharge port 640.

As described above, the projecting portions 810, 820, and 830 of the guide mechanism 800 are arranged at both the side closer to the photoconductor drum 112 and the side farther from the photoconductor drum 112 with respect to the discharge port 640. In the guide mechanism 800, it is desirable that at least two projecting portions be provided at least one of the side closer to the photoconductor drum 112 and the side farther from the photoconductor drum 112 with respect to the discharge port 640.

The second projecting portion 820 and the third projecting portion 830 are arranged at different positions in the top-bottom direction. That is, the second projecting portion 820 and the third projecting portion 830 are arranged such that they are shifted from each other in the top-bottom direction. The first projecting portion 810, the second projecting portion 820, and the third projecting portion 830 are brought into contact with the outer surface of the projecting portion 204 when the projecting portion 204 (see FIG. 5) of the developing device body 202 is inserted into the attaching portion 660 and when the projecting portion 204 of the developing device body 202 is removed from the attaching portion 660, thereby guiding attachment/removal of the developing device 200.

As has been described above, the developing device 200 moves between the position shown in FIG. 3A and the position shown in FIG. 3B so as to rotate about the support shaft 20. Because this movement of the developing device 200 has a left-right direction component in FIG. 3 (FIG. 8), the developing roller 220 approaches the photoconductor drum 112 more as it moves to the left, and the developing roller 220 moves away from the photoconductor drum 112 more as it moves to the right. When the developing device 200 is located at a position where the developing roller 220 is in contact with the photoconductor drum 112 (see FIG. 3A), the first projecting portion 810 and the second projecting portion 820 are brought into contact with the outer surface of the projecting portion 204 to guide the developing device 200.

On the other hand, when the developing roller 220 is located at a position where the developing roller 220 is not in contact with the photoconductor drum 112 (see FIG. 3B), the second projecting portion 820 and the third projecting portion 830 are brought into contact with the outer surface of the projecting portion 204 to guide the developing device 200. In this way, the guide mechanism 800 guides the developing device 200 both in the case where the developing device 200 is located at a position where the developing roller 220 is in contact with the photoconductor drum 112 and in the case where the developing device 200 is located at a position where the developing roller 220 is away from the photoconductor drum 112.

In particular, because the second projecting portion 820 and the third projecting portion 830 are provided to the right (i.e., the direction in which the developing roller 220 moves away from the photoconductor drum 112) of the discharge port 640 in FIG. 8, even when the developing device 200 is attached to or removed from the developer supply device 600 while the developing device 200 is located at a position where the developing roller 220 is away from the photoconductor drum 112, attachment/removal of the developing device 200 is guided by the multiple guide mechanisms.

Furthermore, because the attaching portion 660 is curved so as to form a portion of a cylinder, the second projecting portion 820 and the third projecting portion 830 are disposed at different positions not only in the left-right direction, but also in the top-bottom direction in FIG. 8. That is, the second projecting portion 820 and the second projecting portion 830 are shifted from each other not only in the left-right direction, but also in the top-bottom direction in FIG. 8. The second projecting portion 820 and the third projecting portion 830 enable positioning during attachment/removal of the developing device 200 not only in the left-right direction, but also in the top-bottom direction.

In addition to the case where the developing device 200 is configured to move between the position where it is in contact with the photoconductor drum 112 and the position where it is away from the photoconductor drum 112, as in this exemplary embodiment, there may be a case where the developing device 200 is shifted (displaced) from the developer supply device 600 when the developing device 200 is to be attached to the developer supply device 600. Even in such a case, either the first projecting portion 810 and second projecting portion 820 or the second projecting portion 820 and third projecting portion 830, depending on the position of the developing device 200, come into contact with the projecting portion 204 to guide the developing device 200.

Figure 9A:
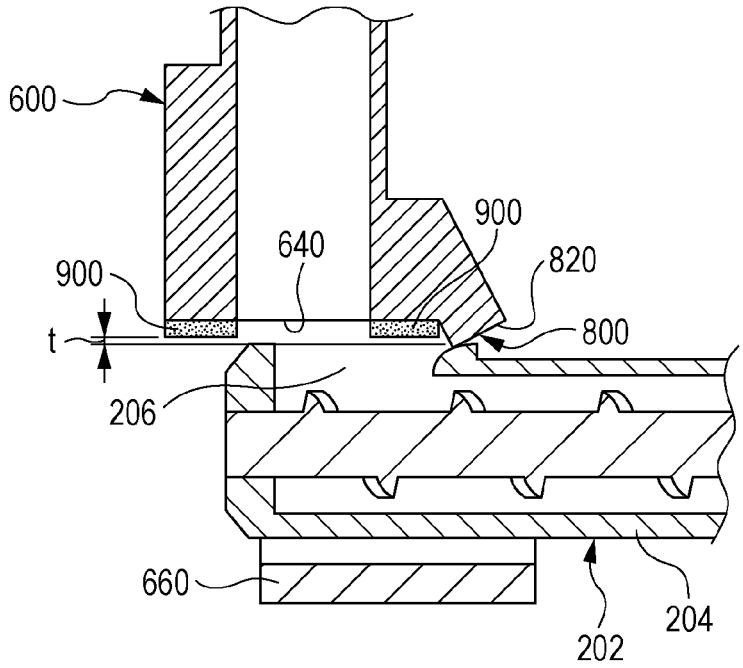
Figure 9B:
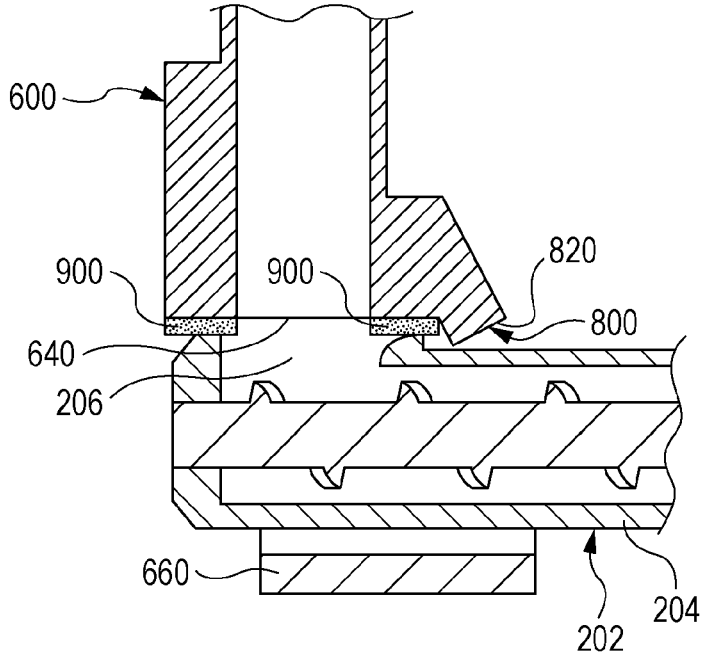

FIGS. 9A and 9B are diagrams for explaining the movement of the developing device 200 guided by the guide mechanism 800, wherein FIG. 9A shows a state immediately before the supply port 206 and the discharge port 640 are connected to each other, and FIG. 9B shows a state in which the supply port 206 and the discharge port 640 are connected to each other.

As shown in FIG. 9A, when the developing device 200 is attached to the developer supply device 600, the guide mechanism 800 causes the developing device 200 to move away from the developer supply device 600, in a direction intersecting the direction in which the developing device 200 is attached to or removed from the developer supply device 600. More specifically, the second projecting portion 820 pushes the developing device 200 downward by resisting the urging force exerted by the first urging member 230 (see FIG. 2), so that the path of the movement of the developing device 200 and the seal member 900 do not interfere with each other. In other words, as shown in FIG. 9A, the second projecting portion 820 guides the movement of the developing device 200 such that a gap t, extending in a direction intersecting the direction in which the developing device 200 is moved, is created between the seal member 900 and the path of the movement of the developing device 200.

With this configuration, the developing device 200 does not rub the seal member 900 when the developing device 200 is attached to the developer supply device 600. Hence, compared with a case where the developing device 200 is moved with the developing device 200 being in contact with the seal member 900, thus rubbing the seal member 900 when the developing device 200 is attached to the developer supply device 600, deterioration of the seal member 900 is less likely to occur.

As shown in FIG. 9B, once the developing device 200 has been attached to the developer supply device 600, the second projecting portion 820 of the guide mechanism 800 is away from the projecting portion 204 of the developing device body 202, and the gap between the discharge port 640 provided in the developer supply device 600 and the supply port 206 provided in the developing device 200 is sealed by the seal member 900.

Figure 10A:
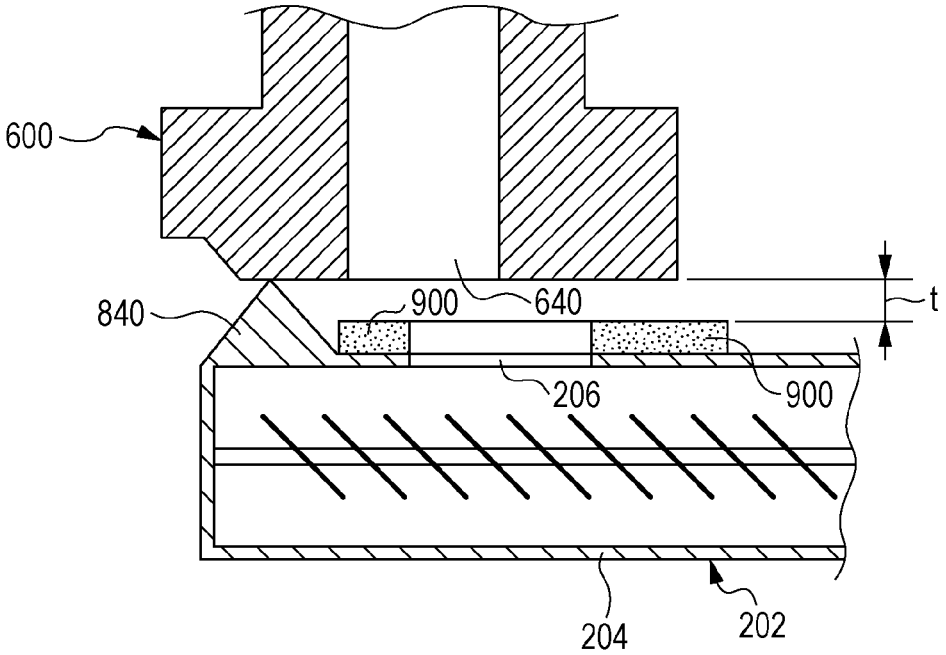
Figure 10B:
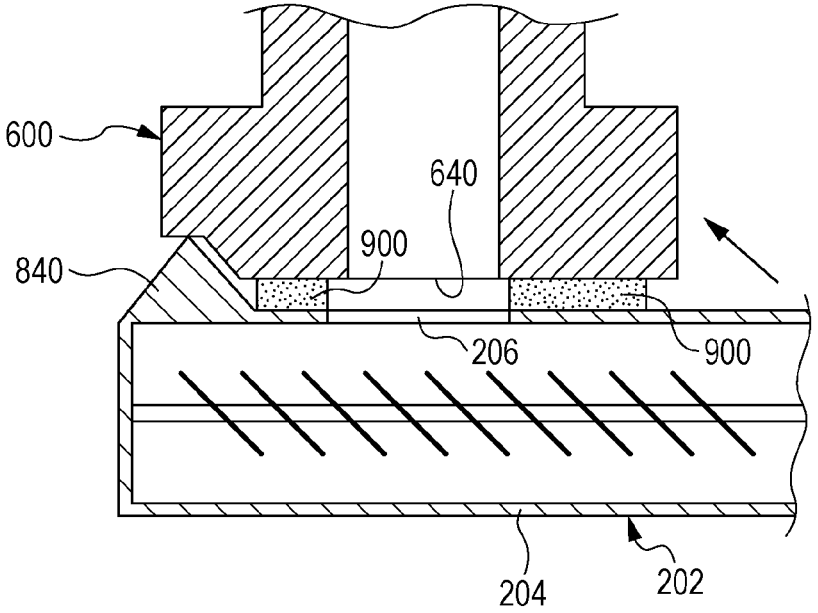

FIGS. 10A and 10B show the configuration and movement of the guide mechanism 800 constituting an image forming apparatus according to a second exemplary embodiment of the present invention, wherein FIG. 10A shows a state immediately before the discharge port 640 of the developer supply device 600 and the supply port 206 of the developing device 200 are connected to each other, and FIG. 10B shows a state in which the discharge port 640 and the supply port 206 are connected to each other. The image forming apparatus according to the second exemplary embodiment has the same configuration as that according to the first exemplary embodiment, except for the configuration of the guide mechanism 800 and the relevant configuration. Hence, only the configuration of the guide mechanism 800 and the relevant configuration will be described below, and the description of the other parts, which are common to the first exemplary embodiment, will be omitted.

In the image forming apparatus according to the first exemplary embodiment of the present invention, the first projecting portion 810, the second projecting portion 820, and the third projecting portion 830 constituting the guide mechanism 800 are formed on the developer supply device 600. In contrast, in the image forming apparatus according to the second exemplary embodiment, a projecting portion 840 constituting the guide mechanism 800 is formed on the projecting portion 204 of the developing device body 202. Furthermore, in the image forming apparatus 10 according to the first exemplary embodiment of the present invention, the seal member 900 is fitted to the developer supply device 600. In contrast, in this second exemplary embodiment, the seal member 900 is fitted to the projecting portion 204 of the developing device body 202.

As shown in FIG. 10A, when the developing device 200 is fitted to the developer supply device 600, the projecting portion 840 moves the developing device 200 in a direction intersecting the direction in which the developing device 200 is attached to or removed from the developer supply device 600. By doing so, the projecting portion 840 guides the movement of the developing device 200 such that the gap t, extending in a direction intersecting the direction in which the developing device 200 moves, is created between the seal member 900 and the developer supply device 600.

With this configuration, the developer supply device 600 does not rub the seal member 900 when the developing device 200 is fitted to the developer supply device 600. Hence, compared with a case where the developing device 200 is moved with the developer supply device 600 being in contact with the seal member 900, thus rubbing the seal member 900 when the developing device 200 is fitted to the developer supply device 600, deterioration of the seal member 900 is less likely to occur.

As shown in FIG. 10B, once the developing device 200 has been attached to the developer supply device 600, the projecting portion 840 of the guide mechanism 800 is away from the developer supply device 600, and the gap between the discharge port 640 provided in the developer supply device 600 and the supply port 206 provided in the developing device 200 is sealed by the seal member 900.

As has been described above, the present invention is applicable to image forming apparatuses, such as copiers, facsimile devices, and printers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a developing device comprising a supply port configured to supply developer, wherein the developing device is configured to develop an image with developer;

a developer supply device to which the developing device is removably attached, wherein the developer supply device comprises a discharge port to be connected to the supply port when the developing device is attached to the developer supply device, and wherein the developer supply device is configured to supply the developer to the developing device through the discharge port;

a seal member configured to seal between the supply port and the discharge port; and a guide portion configured to guide attachment of the developing device to the developer supply device or removal of the developing device from the developer supply device so as not to rub the seal member, wherein the guide portion comprises a projecting portion configured to cause the developing device to move away from the developer supply device, in a direction intersecting a direction in which the developing device is attached to or removed from the developer supply device, and wherein the projecting portion is provided on at least one of the developing device and the developer supply device.

2. The image forming apparatus according to claim 1, further comprising an image carrier that carries a latent image developed by the developing device, wherein the developing device includes a developer carrier configured to carry the developer and configured to be movable toward and away from the image carrier, and wherein the guide portion is configured guide the developing device both in the case where the developing device is located at a position where the developer carrier is in contact with the image carrier and in the case where the developing device is located at a position where the developer carrier is away from the image carrier.

3. The image forming apparatus according to claim 1, wherein the projecting portion includes a plurality of projecting portions, the plurality of projecting portions being disposed at a side closer to the image carrier and a side farther from the image carrier with respect to the discharge port, and wherein at least two projecting portions are provided at least one of the side closer to the image carrier and the side farther from the image carrier with respect to the discharge port.

4. The image forming apparatus according to claim 3, wherein the plurality of projecting portions provided at the side farther from the image carrier with respect to the discharge port are configured to guide the developing device at least when the developing device is located at the position where the developer carrier is away from the image carrier.

5. The image forming apparatus according to claim 1, wherein the seal member is fitted to the developing device.

6. The image forming apparatus according to claim 1, wherein the developer supply device further includes a closing member configured to close the discharge port when the developing device is removed from the developer supply device.

* * * * *